US005406165A

United States Patent [19]

Pragt

[11] Patent Number: 5,406,165

[45] Date of Patent: Apr. 11, 1995

[54] HIGH PRESSURE DISCHARGE LAMP HAVING A CONTAINMENT SLEEVE FUSED TO THE EXHAUST TUBE

[75] Inventor: Henrikus J. H. Pragt, Eindhoven, Netherlands

[73] Assignee: U.S. Philips Corporation, New York, N.Y.

[21] Appl. No.: 994,571

[22] Filed: Dec. 22, 1992

[30] Foreign Application Priority Data

Dec. 23, 1991 [EP] European Pat. Off. ..... 91203378

[51] Int. Cl.[6] ..... H01J 5/02

[52] U.S. Cl. ..... 313/25; 313/312; 313/573; 313/634; 362/186

[58] Field of Search ..... 313/25, 493, 570, 571, 313/573, 634, 635, 312, 580, 315, 578, 579, 312; 362/186; 220/2.1 R

[56] References Cited

U.S. PATENT DOCUMENTS 4,678,960 7/1987 Reiling ..... 313/25
4,721,876 1/1988 White et al. ..... 313/25
4,942,330 7/1990 Karlotski et al. ..... 313/25
4,950,938 8/1990 Ramaiah ..... 313/634 X
5,128,589 7/1992 Dakin ..... 313/634

FOREIGN PATENT DOCUMENTS 0381265 1/1990 European Pat. Off. .
8902687 5/1991 Netherlands .

*Primary Examiner*—Michael Horabik
*Assistant Examiner*—Ashok Patel
*Attorney, Agent, or Firm*—Brian J. Wieghaus

[57] ABSTRACT

An electric lamp has a lamp vessel (2) mounted in an outer bulb (1). A glass containment sleeve (10) surrounds the lamp vessel and is fused to a tipped off exhaust tube (5). A coiled wire (11) surrounds the sleeve 10 and provides further containment. The wire may be fixed to the sleeve (10) by clamping fit. The construction of the lamp is simple and effective to protect the outer bulb (1) from being damaged by an explosion of the lamp vessel (2).

4 Claims, 1 Drawing Sheet

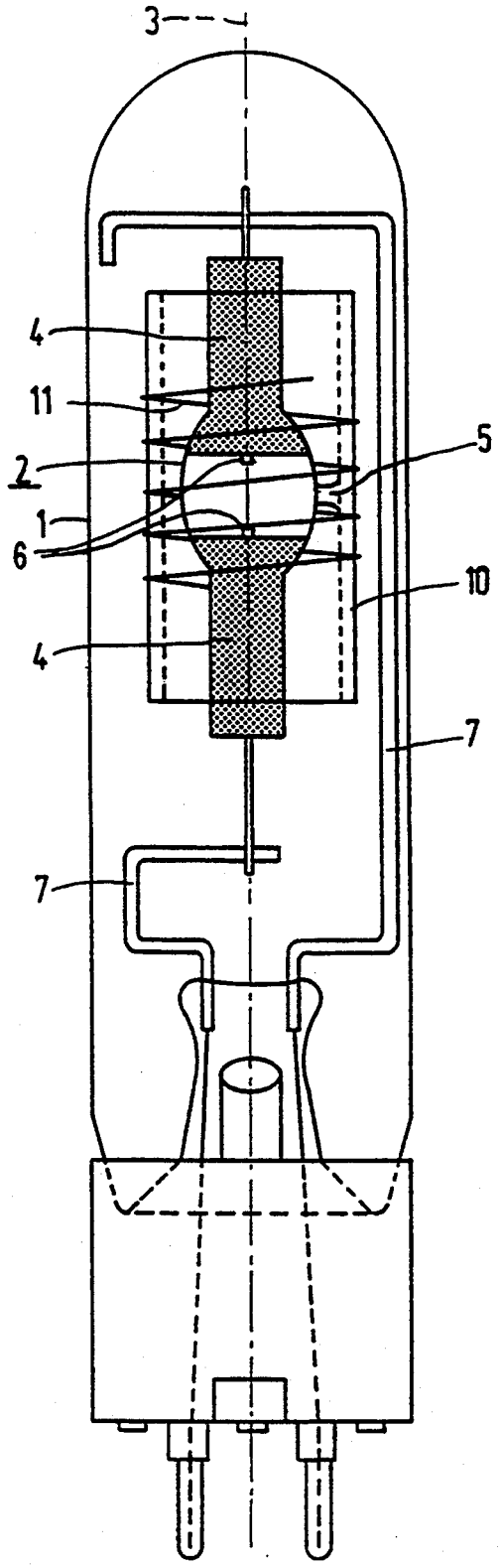
3
4
11
2
1
6
5
10
4
7
7

HIGH PRESSURE DISCHARGE LAMP HAVING A CONTAINMENT SLEEVE FUSED TO THE EXHAUST TUBE

CROSS REFERENCE TO RELATED APPLICATION

This application relates to U.S. application Ser. No. 994,572 entitled "Electric Discharge Lamp" of Henrikus J. H. Pragt filed concurrently herewith which discloses an HID lamp having a tubular shield with a helically coiled metal wire surrounding the shield and which is electrically floating.

BACKGROUND OF THE INVENTION

The invention relates to an electric lamp comprising:

an outer bulb closed in a gaslight manner;

a lamp vessel closed in a gastight manner and having an axis, seals on its axis, and an exhaust tube seal between said seals;

a glass containment sleeve axially surrounding the lamp vessel;

a member surrounding the sleeve;

an electric element in the lamp vessel; and current conductors which extend from outside the outer bulb to the electric element and are connected thereto.

Such an electric lamp is known from EP 0 381 265-A. In the known lamp, the glass containment sleeve is mounted to the seals of the lamp vessel or to the current conductors which issue therefrom to the exterior. Metal plates which close in the sleeve between them are used for this. The glass sleeve is a double walled tube or is surrounded by a separate glass tube.

The construction of the known lamp envisages to keep the outer bulb intact if the lamp vessel should explode. Explosion is possible when the lamp reaches the end of its life.

Netherlands Patent Application 89 02 687-A discloses a similar lamp in which the glass tube is surrounded by a perforated metal foil.

The construction of the known lamps is reliable, but complicated and therefore expensive.

SUMMARY OF THE INVENTION

It is an object of the invention to provide an electric lamp of the kind mentioned in the opening paragraph which is of a simple construction.

According to the invention, this object is achieved in that the glass containment sleeve is fused to the exhaust tube seal of the lamp vessel.

It was found that the fusion of the glass sleeve to the exhaust tube seal constitutes a simple and reliable fastening of the sleeve in the lamp. No additional parts are necessary for this fastening, so that the manufacture of the lamp is logistically simpler and requires less assembling work.

The glass containment tube may have, for example, a known surrounding member, such as another glass tube, or a metal surrounding member, such as a perforated foil, or a metal or glass gauze or mesh.

A surrounding member which can be readily manufactured and mounted, and which in addition is light, however, consists of a helically coiled metal wire. This wire may be fastened to one of the current conductors, possibly electrically insulated therefrom. An alternative possibility, however, is that the wire is fastened to the sleeve, for example, in that wire ends are fastened to the sleeve with cement or are fused into the sleeve.

A very attractive, convenient and reliable fastening is one in which the wire is fastened to the sleeve by its own clamping force. The wire has in that case been coiled on a mandrel having a smaller diameter than the sleeve and has been twisted against its coiling direction immediately before assembly so as to give its turns a greater diameter. After the wire has been provided around the sleeve, the twisting force is lifted and the wire will surround the sleeve with clamping fit.

In spite of the comparatively great pitch which the wire may have, for example, several mm, the wire provides a screening for the current conductor extending alongside the lamp vessel, thus counteracting the disappearance of sodium, if present, from the lamp vessel.

The electric element of the lamp may be, for example, a pair of electrodes in an ionizable gas filling.

BRIEF DESCRIPTION OF THE DRAWING

An embodiment of the electric lamp according to the invention is shown in the drawing in side elevation.

DESCRIPTION OF THE PREFERRED EMBODIMENT

In the Figure, the electric lamp has an outer bulb 1 which is closed in a gaslight manner and a lamp vessel 2 which is closed in a gaslight manner and which has an axis 3, seals 4 on its axis, and an exhaust tube seal 5 between said seals. A glass containment sleeve 10, for example made of quartz glass, axially surrounds the lamp vessel. The sleeve has a surrounding member 11. An electric element 6 is present in the lamp vessel, in the Figure this is a pair of electrodes in an ionizable medium. Current conductors 7 extend from outside the outer bulb to the electric element and are connected thereto.

The glass containment sleeve 10 is fused to the exhaust tube seal 5 of the lamp vessel 2. The sleeve may have a wail thickness of, for example, 1 mm or less.

The member 11 surrounding the sleeve 10 is a helically coiled metal wire. For this purpose, for example, resistance wire may be used, for example kanthal wire. In the lamp shown, wire of 0.25 mm diameter is used, coiled with a pitch of 5 min. Alternatively, however, a thinner wire, for example of 0.2 mm, or a greater pitch may be used, for example 7 mm. The coiled wire is thin and has an open structure. Its influence on the luminous flux of the lamp, therefore, is scarcely perceivable.

The wire 11 is fastened to the sleeve 10 by its own clamping force.

The lamp shown is a high-pressure metal halide discharge lamp which contains metal halides, mercury, and rare gas. The lamp consumes a power of 70 W during operation. During stable lamp operation, the lamp vessel was made to explode by means of a current surge. The outer bulb remained entirely undamaged during this, which proves that the lamp construction effectively protects the surroundings against the consequences of an explosion of the lamp vessel.

An attractive feature of the shown lamp is that the glass sleeve is arranged so as to be electrically insulated from the current conductors. The member surrounding the sleeve is also electrically insulated. Disappearance of sodium, if present, from the discharge vessel is effectively counteracted by this. If an electron should be detached from the wire by UV radiation, the wire is given a positive potential which slows down further electron losses.

I claim:

1. An electric lamp, comprising:

an outer bulb closed in a gastight manner;

a lamp vessel closed in a gastight manner and having an axis, seals on its axis, and an exhaust tube seal between said seals;

a glass containment sleeve axially surrounding said lamp vessel, said sleeve being fused to said exhaust tube seal of said lamp vessel;

a member surrounding said sleeve;

an electric element in said lamp vessel; and current conductors which extend from outside said outer bulb and are connected to said electric element.

2. An electric lamp as claimed in claim 1, wherein said member surrounding said sleeve is a helically coiled metal wire.

3. An electric lamp as claimed in claim 2, wherein said metal wire is fastened to said sleeve.

4. An electric lamp as claimed in claim 3, wherein said metal wire is fastened to said sleeve by its own clamping force.

* * * * *